US007902138B2

(12) United States Patent
Ouwendijk-Vrijenhoek et al.

(10) Patent No.: US 7,902,138 B2
(45) Date of Patent: Mar. 8, 2011

(54) LIQUID DETERGENT COMPOSITION

(75) Inventors: Maartje Ouwendijk-Vrijenhoek, Vlaardingen (NL); Derdiyok Sonmezer, Vlaardingen (NL); Simon Marinus Veerman, Vlaardingen (NL)

(73) Assignee: The Sun Products Corporation, Wilton, CT (US)

( * ) Notice: Subject to any disclaimer, the term of this patent is extended or adjusted under 35 U.S.C. 154(b) by 1022 days.

(21) Appl. No.: 11/009,639

(22) Filed: Dec. 10, 2004

(65) Prior Publication Data

US 2005/0130864 A1 Jun. 16, 2005

(30) Foreign Application Priority Data

Dec. 11, 2003 (EP) ..... 03078937

(51) Int. Cl.
*C11D 17/00* (2006.01)

(52) U.S. Cl. ..... 510/276; 510/101; 510/299; 510/300; 510/302; 510/305; 510/306

(58) Field of Classification Search ..... 510/392, 510/393, 405, 515, 327, 320, 101, 276, 299, 510/300, 302, 305, 306; 512/25
See application file for complete search history.

(56) References Cited

U.S. PATENT DOCUMENTS

| | | | | |
|---|---|---|---|---|
| 4,238,345 | A | 12/1980 | Guilbert | 252/174.12 |
| 5,094,761 | A * | 3/1992 | Trinh et al. | 510/515 |
| 5,234,610 | A * | 8/1993 | Gardlik et al. | 510/327 |
| 5,565,135 | A | 10/1996 | Dauderman et al. | 510/281 |
| 7,030,069 | B2 * | 4/2006 | Gupta et al. | 510/101 |
| 2002/0032147 | A1 * | 3/2002 | Foley et al. | 512/25 |
| 2005/0130864 | A1 * | 6/2005 | Ouwendijk-Vrijenhoek et al. | 510/392 |

FOREIGN PATENT DOCUMENTS

| | | |
|---|---|---|
| EP | 042 648 | 12/1981 |
| EP | 370 596 | 5/1990 |
| WO | 96/12786 | 5/1996 |
| WO | 98/29526 | 7/1998 |
| WO | 99/57233 | 11/1999 |

OTHER PUBLICATIONS

European Search Report in an EP application EP 03 07 8937.
Japanese Abstract JP 2003 049195 published Feb. 21, 2003.
Japanese Abstract JP 2001 254099 published Sep. 18, 2001.

* cited by examiner

*Primary Examiner*—Lorna M Douyon
*Assistant Examiner*—Tri V Nguyen
(74) *Attorney, Agent, or Firm*—Sterne, Kessler, Goldstein & Fox P.L.L.C.

(57) ABSTRACT

The present invention provides a liquid detergent composition comprising an effective amount of an enzyme, 0.001-3% wt of a perfume ingredient, and 0.005-2% wt of an anti-oxidant. It has been found that the storage stability of the enzyme—which is preferably a protease—can be drastically improved by the addition of the anti-oxidant.

9 Claims, No Drawings

LIQUID DETERGENT COMPOSITION

FIELD OF THE INVENTION

The present invention relates to detergent compositions containing enzymes, wherein the activity of the enzyme has been stabilised against deterioration (e.g. by degradation of the enzyme molecule) during storage. The stabilised liquid enzyme-containing detergent compositions of the invention are particularly useful in methods for removing proteinaceous soils from fabric substrates, so as to clean those substrates.

BACKGROUND OF THE INVENTION

In liquid detergent compositions, especially those for the washing of textile fabrics, it is common to include one or more enzymes for assisting removal of various kinds of soil. Amongst these are proteolytic enzymes, often referred to as "proteases". Proteases are used to assist in the removal of protein-based soil.

However, the very nature and activity of these enzymes means that they attack any other component in the liquid composition which has a protein-like structure. As a result, they can degrade other enzymes in the liquid, as well as undergo self-degradation. To counteract this, it is usual also to incorporate an enzyme stabilising system. Such stabilising systems commonly consist of a boron compound, e.g. borax, together with a polyol, e.g. glycerol or sorbitol. These components are believed to form an enzyme-inhibiting complex which dissociates by dilution of the composition into the wash liquor, disabling the inhibiting effect so that the protease can act upon the proteinaceous soil.

Other protease stabilisers such as calcium chloride/calcium format are also known but are not as effective as those systems based on boron. On the other hand, it may be desirable for environmental reasons to reduce the amount of boron in the detergent composition.

Another type of enzyme stabilising system for use in enzyme-containing liquid detergent compositions is disclosed by U.S. Pat. No. 4,238,345. This document discloses that the combination of an antioxidant having a standardised redox potential at least equal to that of ascorbic acid but less than that of sodium hydrosulphite, with hydrophylic polyol is an effective stabilising system for proteolytic enzymes.

We have found in this connection that perfumes generally can degrade proteolytic and lipolytic enzymes when also present in liquid detergent compositions. In particular, we have found that some specific perfume components particularly degrade protease and lipase enzymes when present in the liquid detergent composition.

In view of this, it is an object of the present invention to provide an effective liquid detergent composition containing both a proteolytic and/or lipolytic enzyme and a perfume composition, and having favourable storage stability.

We have now surprisingly found that this object can be achieved by using a perfume composition in the liquid detergent composition, and combining it with an antioxidant.

In other words, we have found that a protease and/or lipase-containing liquid detergent composition having favourable storage stability characteristics can be obtained, when that composition contains an antioxidant in combination with a perfume composition.

DEFINITION OF THE INVENTION

Accordingly, in one aspect the present invention provides a liquid detergent composition comprising:

(a) a cleaning effective amount of an enzyme selected from a proteolytic enzyme, a lipolytic enzyme, and a mixture thereof;

(b) from 0.001% to 3% by weight of a perfume composition; and (c) from 0.005 to 2% by weight of an antioxidant selected from the group consisting of an alkylated phenol (as defined herein) α, β, γ, δ-tocopherol, ethoxyquine, 2,2,4-trimethyl-1,2-dihydroquinoline, 2,6-di-tert-butyl-hydroquinone, tert-butyl-hydroxy anysole, lignosulphonic acid and salts thereof, 6-hydroxy-2,5,7,8-tetra-methylchroman-2-carboxylic acid (Trolox™), 1,2-benzisothiazoline-3-one (Proxel GXL™, a benzofuran or benzopyran derivative (as defined herein), tocopherol sorbate, butylated hydroxy benzoic acid and its salts, gallic acid and its alkyl esters, uric acid and its salts and alkyl esters, sorbic acid and its salts, dihydroxy fumaric acid and its salts, and mixtures thereof.

Furthermore, in a second aspect the invention provides a method of cleaning a fabric substrate, comprising the steps of treating the substrate with a liquid composition of the present invention in an aqueous environment, rinsing the substrate and drying it. In a further aspect, the invention provides the use of an antioxidant as specified in the claims in a liquid laundry detergent composition containing 0.001-3% by weight of a perfume composition and a cleaning effective amount of an enzyme selected from a proteolytic enzyme, a lipolytic enzyme, an amylolytic enzyme, a cellulolytic enzyme and a mixture thereof, for improving the storage stability of the liquid laundry detergent composition.

DETAILED DESCRIPTION OF THE INVENTION

The Liquid Detergent Composition

Liquid detergent compositions generally can be considered either to be isotropic or structured. The liquid cleaning composition may be formulated as a concentrated cleaning liquid for direct application to a substrate, or for application to a substrate following dilution, such as dilution before or during use of the liquid composition by the consumer or in washing apparatus.

Whilst the composition and method according to the present invention may be used for cleaning any suitable substrate, the preferred substrate is a laundry fabric. Cleaning may be carried out by simply leaving the substrate in contact for a sufficient period of time with a liquid medium constituted by or prepared from the liquid cleaning composition. Preferably, however, the cleaning medium on or containing the substrate is agitated.

Product Form

The liquid detergent composition according to the present invention is preferably a concentrated liquid cleaning composition. Furthermore, said liquid detergent composition is preferably isotropic.

It should be understood that the liquid compositions according to any aspect of the present invention have a physical form which preferably ranges from a pourable liquid, a pourable gel to a non-pourable gel. These forms are conveniently characterised by the product viscosity. In these definitions, and unless indicated explicitly to the contrary, throughout this specification, all stated viscosity's are those measured at a shear rate of 21 $s^{-1}$ and at a temperature of 25° C.

Pourable liquid compositions according to any aspect of the present invention preferably have a viscosity of no more than 1,500 mPa·s, more preferably no more than 1,000 mPa·s, still more preferably, no more than 500 mPa·s.

Compositions according to any aspect of the present invention which are pourable gels, preferably have a viscosity of at least 1,500 mPa·s but no more than 6,000 mPa·s, more preferably no more than 4,000 mPa·s, still more preferably no more than 3,000 mPa·s and especially no more than 2,000 mPa·s.

Compositions according to any aspect of the present invention which are non-pourable gels, preferably have a viscosity of at least 6,000 mPa·s but no more than 12,000 mPa·s, more preferably no more than 10,000 mPa·s, still more preferably no more than 8,000 mPa·s and especially no more than 7,000 mPa·s.

Physically Stable

For the purpose of this invention a composition is physically stable when less than 2% phase separation occurs after 2 week storage at 37° C. With isotropic liquids this phase separation generally starts with the liquid becoming hazy.

Water

Preferably the amount of water in the liquid detergent composition is from 5 to 95%, more preferred from 30 to 80%, by weight.

Antioxidant

The liquid detergent composition of the invention from 0.005 to 2% by weight of an anti-oxidant. Preferably, the anti-oxidant is present at a concentration in the range of 0.01 to 0.08% by weight.

Anti-oxidants are substances as described in Kirk-Othmers (Vol 3, pg 424) and in Uhlmans Encyclopedia (Vol 3, pg 91).

One class of anti-oxidants used in the present invention is alkylated phenols having the general formula:

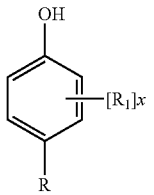

wherein R is $C_1$-$C_{22}$ linear or branched alkyl, preferably methyl or branched $C_3$-$C_6$ alkyl; $C_3$-$C_6$ alkoxy, preferably methoxy; $R_1$ is a $C_3$-$C_6$ branched alkyl, preferably tert-butyl; x is 1 or 2. Hindered phenolic compounds are a preferred type of alkylated phenols according to this formula. A preferred hindered phenolic compound of this type is 2,6-di-tert-butyl-hydroxy-toluene (BHT).

Furthermore, the antioxidant used in the composition of the invention is selected from the group consisting of α, β, γ, δ-tocopherol, ethoxyquine, 2,2,4-trimethyl-1,2-dihydroquinoline, 2,6-di-tert-butyl hydroquinone, tert-butyl-hydroxy anisole, lignosulphonic acid and salts thereof, and mixtures thereof. It is noted that ethoxyquine (1,2-dihydro-6-ethoxy-2,2,4-trimethylchinolin) is marketed under the name Raluquin™ by the company Rashig™.

Other type of antioxidant used in the present invention are 6-hydroxy-2,5,7,8-tetra-methylchroman-2-carboxylic acid (Trolox™) and 1,2-benzisothiazoline-3-one (Proxel GXL™).

A further class of anti-oxidants which may be suitable for use in the present invention is a benzofuran or benzopyran derivative having the formula:

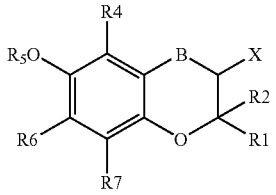

wherein $R_1$ and $R_2$ are each independently alkyl or $R_1$, and $R_2$ can be taken together to form a $C_5$-$C_6$ cyclic hydrocarbyl moiety; B is absent or $CH_2$; $R_4$ is $C_1$-$C_6$ alkyl; $R_5$ is hydrogen or —C(O)$R_3$ wherein $R_3$ is hydrogen or $C_1$-$C_{19}$ alkyl; $R_6$ is $C_1$-$C_6$ alkyl; $R_7$ is hydrogen or $C_1$-$C_6$ alkyl; X is —$CH_2$OH, or —$CH_2$A wherein A is a nitrogen comprising unit, phenyl, or substituted phenyl. Preferred nitrogen comprising A units include amino, pyrrolidino, piperidino, morpholino, piperazino, and mixtures thereof.

Anti-oxidants such as tocopherol sorbate, butylated hydroxy benzoic acids and their salts, gallic acid and its alkyl esters, uric acid and its salts and alkyl esters, sorbic acid and its salts, and dihydroxy fumaric acid and its salts may also be used.

The preferred types of anti-oxidants for use in the present invention are 2,6-di-tert-butyl-hydroxy-toluene (BHT), α-, β-, γ-, δ-tocopherol, 6-hydroxy-2,5,7,8-tetra-methylchroman-2-carboxylic acid (Trolox™), 1,2-benzisothiazoline-3-one (Proxel GXL™) and mixtures thereof. The most preferred anti-oxidants are 2,6-di-tert-butyl-hydroxy-toluene (BHT, 1,2-benzisothiazoline-3-one (Proxel GXL™) and mixtures thereof.

Perfume Component

The liquid composition of the present invention comprises between 0.001 to 3 wt/wt % of a perfume composition, preferably between 0.01 to 2 wt/wt % of a perfume composition. Said perfume composition preferably comprises at least 0.01% by weight based on the liquid composition of a perfume component selected from terpenes, ketones, aldehydes and mixtures thereof. The perfume composition may fully consist of the perfume component but generally the perfume composition is a complex mixture of perfumes of various differing perfume classifications. In this regard, the perfume composition preferably comprises at least 0.1%, more preferably at least 1.0%, still more preferably at least 5% by weight of the perfume component. At higher levels of the perfume component, the positive effect of the antioxidant with regard to the storage stability of the liquid composition is greater.

Having regard to the terpene perfume component, the present invention has particular utility with the following preferred terpene perfume components:

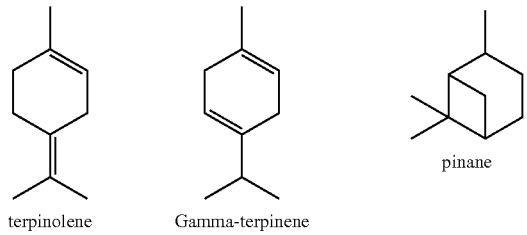

Having regard to the ketone perfume component, the present invention has particular utility to the following preferred ketonic perfume components:

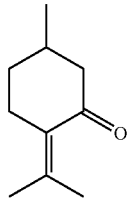

pulegone

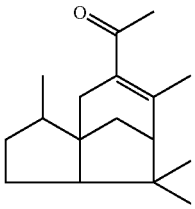

vertofix coeur

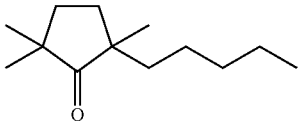

veloutone

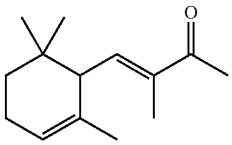

Alpha-methylionone

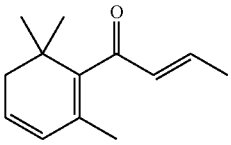

damascenone

With regard to the aldehydic perfume component, the present invention has particular utility with the following preferred aldehydic perfume components:

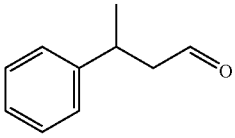

trifernal

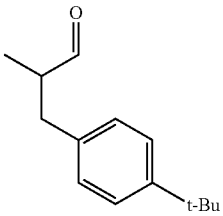

lilial

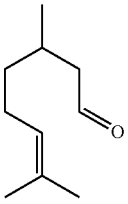

citronellal

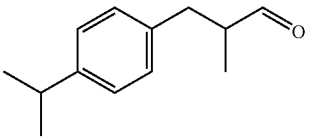

cyclosal

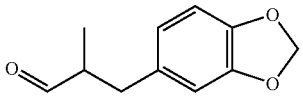

heliopropanal

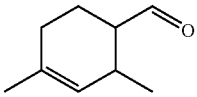

zestover

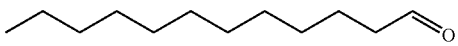

Aldehyde C12

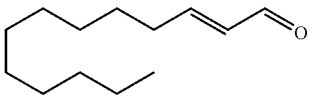

tridecylenicaldehyde

-continued

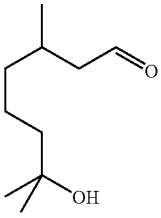

Cyclosia base

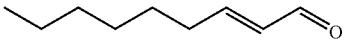

octenal

Enzymes

"Detersive enzyme", as used herein, means any enzyme having a cleaning, stain removing or otherwise beneficial effect in a laundry application. Enzymes are included in the present detergent compositions for a variety of purposes, including removal of protein-based, saccharide-based, or triglyceride-based stains, for the prevention of refugee dye transfer, and for fabric restoration.

The composition of the invention contains an enzyme selected from a protease, a lipase, an amylase, a cellulase and mixtures thereof. Preferably, said composition contains a protease enzyme.

Other suitable enzymes include oxidases, peroxidases, and mixtures thereof of any suitable origin, such as vegetable, animal, bacterial, fungal and yeast origin.

Preferred selections are influenced by factors such as pH-activity and/or stability optima, thermo-stability, and stability to active detergents, builders and the like. In this respect bacterial or fungal enzymes are preferred, such as bacterial amylases and proteases, and fungal cellulases.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.001 mg to 3 mg, of active enzyme per gram of the detergent composition. Stated otherwise, the compositions herein will typically comprise from 0.0001% to 10%, preferably from 0.001% to 5%, more preferably 0.005%-1% by weight of a commercial enzyme preparation.

The Proteolytic Enzyme

Endopeptidases (proteolytic enzymes or proteases) of various qualities and origins and having activity in various pH ranges of from 4-12 are available and can be used in the instant invention. Examples of suitable proteolytic enzymes are the subtilisins, which can be obtained from particular strains of *B. subtilis, B. lentus, B. amyloliquefaciens* and *B. licheniformis*, such as the commercially available subtilisins Savinase™, Alcalase™, Relase™, Kannase™ and Everlase™ as supplied by Novo Industri A/S, Copenhagen, Denmark or Purafect™, PurafectOxP™ and Properase™ as supplied by Genencor International. Chemically or genetically modified variants of these enzymes are included such as described in WO-A-99/02632 pages 12 to 16 and in WO-A-99/20727 and also variants with reduced allergenicity as described in WO-A-99/00489 and WO-A-99/49056

It should be understood that the protease is present in the liquid detergent composition of the invention in a dissolved or dispersed form, i.e., the protease is not encapsulated to prevent the protease from the liquid composition. Instead the protease in more or less in direct contact with the liquid composition.

Suitable examples of proteases are the subtilisins which are obtained from particular strains of *B. subtilis* and *B. licheniformis*. One suitable protease is obtained from a strain of *Bacillus*, having maximum activity throughout the pH range of 8-12, developed and sold as ESPERASE™ by Novo Industries A/S of Denmark, hereinafter "Novo". The preparation of this enzyme and analogous enzymes is described in GB 1,243,784 to Novo. Other suitable proteases include ALCALASE™ and SAVINASE™ from Novo and MAXATASE™ from International Bio-Synthetics, Inc., The Netherlands; as well as Protease A as disclosed in EP-A-130,756, and Protease B as disclosed in EP-A-303,761 and EP-A-130,756. See also a high pH protease from *Bacillus* sp. NCIMB 40338 described in WO-A-93/18140 to Novo. Enzymatic detergents comprising protease, one or more other enzymes, and a reversible protease inhibitor are described in WO-A-92/03529. Other preferred proteases include those of WO-A-95/10591. When desired, a protease having decreased adsorption and increased hydrolysis is available as described in WO-A-95/07791. A recombinant trypsin-like protease for detergents suitable herein is described in WO-A-94/25583.

Useful proteases are also described in PCT publications: WO-95/30010, WO-95/30011, WO-95/29979.

Preferred proteolytic enzymes are also modified bacterial serine proteases, such as those described in EP-A-251,446 (particularly pages 17, 24 and 98), and which is called herein "Protease B", and in EP-A-199,404, which refers to a modified bacterial serine proteolytic enzyme which is called "Protease A" herein, Protease A as disclosed in EP-A-130,756.

The preferred liquid laundry detergent compositions according to the present invention comprise at least 0.001% by weight, of a protease enzyme. However, an effective amount of protease enzyme is sufficient for use in the liquid laundry detergent compositions described herein. The term "an effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.001 mg to 3 mg, of active enzyme per gram of the detergent composition. Stated otherwise, the compositions herein will typically comprise from 0.001% to 5%, preferably 0.01%-1% by weight of a commercial enzyme preparation. Typically, the proteolytic enzyme content is up to 0.2%, preferably from $4\times10^{-5}$% to 0.06% by weight of the composition of pure enzyme.

Lipolytic Enzyme

As outlined above, the liquid composition of the invention may also contain a lipolytic enzyme. In particular, the composition may contain 10-20,000 LU per gram of the detergent composition of a lipolytic enzyme selected from the group consisting of Lipolase, Lipolase ultra, LipoPrime, Lipomax, Liposam, and lipase from *Rhizomucor miehei* (e.g. as described in EP-A-238,023 (Novo Nordisk).

Suitable other enzymes for use in the compositions of the invention can be found in the enzyme classes of the esterases and lipases, (EC 3.1.1.*, wherein the asterisk denotes any number).

A characteristic feature of lipases is that they exhibit interfacial activation. This means that the enzyme activity is much higher on a substrate which has formed interfaces or micelles, than on fully dissolved substrate. Interface activation is reflected in a sudden increase in lipolytic activity when the substrate concentration is raised above the critical micel concentration (CMC) of the substrate, and interfaces are formed. Experimentally this phenomenon can be observed as a discontinuity in the graph of enzyme activity versus substrate concentration. Contrary to lipases, however, cutinases do not exhibit any substantial interfacial activation.

Suitable lipase enzymes for detergent usage include those produced by microorganisms of the Pseudomonas group, such as Pseudomonas stutzeri ATCC 19.154, as disclosed in GB 1,372,034. See also lipases in Japanese Patent Application 53,20487. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE™ enzyme derived from *Humicola lanyginosa* and commercially available from Novo, see also EP-A-341,947, is a preferred lipase for use herein. Lipase and amylase variants stabilized against peroxidase enzymes are described in WO-A-94/14951 to Novo. See also WO-A-92/05249. Cutinase enzymes suitable for use herein are described in WO-A-88/09367 to Genencor.

Of main interest for the present invention are fungal lipases, such as those from *Humicola lanuginosa* and *Rhizomucor miehei*. Particularly suitable for the present invention is the lipase from *Humicola lanuginosa* strain DSM 4109, which is described in EP-A-305 216 (Novo Nordisk), and which is commercially available as Lipolase (™). Also suitable are variants of this enzyme, such as described in WO-A-92/05249, WO-A-94/25577, WO-A-95/22615, WO-A-97/04079, WO-A-97/07202, WO-A-99/42566, WO-A-00/60063. Especially preferred is the variant D96L which is commercially available from Novozymes as Lipolase ultra, and the variant which is sold by Novozymes under the trade name LipoPrime.

The lipolytic enzyme suitable for use in the present invention can usefully be added to the detergent composition in any suitable form, i.e. the form of a granular composition, a slurry of the enzyme, or with carrier material (e.g. as in EP-A-258,068 and the Savinase™ and Lipolase™ products of Novozymes). A good way of adding the enzyme to a liquid detergent product is in the form of a slurry containing 0.5 to 50% by weight of the enzyme in a ethoxylated alcohol nonionic surfactant, such as described in EP-A-450,702 (Unilever).

Other Enzymes

Other optional suitable enzymes that may be included alone or in combination with any other enzyme may, for example, be oxidoreductases, transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN 0-12-227165-3, Academic Press.

Examples of the oxidoreductases are oxidases such as glucose oxidase, methanol oxidase, bilirubin oxidase, catechol oxidase, laccase, peroxidases such as ligninase and those described in WO-A-97/31090, monooxygenase, dioxygenase such as lipoxygenase and other oxygenases as described in WO-A-99/02632, WO-A-99/02638, WO-A-99/02639 and the cytochrome based enzymatic bleaching systems described in WO-A-99/02641.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase.

A range of enzyme materials and means for their incorporation into synthetic detergent compositions is also disclosed in WO-A-93/07263 and WO-A-93/07260 to Genencor International, WO-A-89/08694 to Novo, and U.S. Pat. No. 3,553,139.

A process for enhancing the efficacy of the bleaching action of oxidoreductases is by targeting them to stains by using antibodies or antibody fragments as described in WO-A-98/56885. Antibodies can also be added to control enzyme activity as described in WO-A-98/06812.

A preferred combination is a detergent composition comprising of a mixture of the protease, lipase, amylase and/or cellulase of the invention together with one or more plant cell wall degrading enzymes.

Suitable amylases include those of bacterial or fungal origin. Chemically or genetically modified variants of these enzymes are included as described in WO-A-99/02632 pages 18, 19. Commercial cellulase are sold under the tradename Purastar™, Purastar OxAm™ (formerly Purafact Ox Am™) by Genecor; Termamyl™, Fungamyl™, Duramyl™, Natalase™, all available from Novozymes.

Amylases suitable herein include, for example, alfa-amylases described in GB 1,296,839 to Novo; RAPIDASE™, International Bio-Synthetics, Inc. and TERMAMYL™, Novo. FUNGAMYL™ from Novo is especially useful.

See, for example, references disclosed in WO-A94/02597. Stability-enhanced amylases can be obtained from Novo or from Genencor International. One class of highly preferred amylases herein have the commonality of being derived using site-directed mutagenesis from one or more of the *Baccillus* amylases, especially the *Bacillus* cc-amylases, regardless of whether one, two or multiple amylase strains are the immediate precursors.

Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to WO-A-94/02597 known as TERMAMYL™.

Particularly preferred amylases herein include amylase variants having additional modification in the immediate parent as described in WO-A-95/10603 and are available from the assignee, Novo, as DURAMYL™. Other particularly preferred oxidative stability enhanced amylase include those described in WO-A-94/18314 to Genencor International and WO-A-94/02597 to Novo Or WO-A-95/09909 A to Novo.

Suitable cellulases include those of bacterial or fungal origin. Chemically or genetically modified variants of these enzymes are included as described in WO-A-99/02632, page 17. Particularly useful cellulases are the endoglucanases such as the EGIII from *Trichoderma longibrachiatum* as described in WO-A-94/21801 and the E5 from *Thermomonospora fusca* as described in WO-A-97/20025. Endoglucanases may consist of a catalytic domain and a cellulose binding domain or a catalytic domain only. Preferred cellulolytic enzymes are sold under the tradename Carezyme™, Celluzyme™ and Endolase™ by Novo Nordisk A/S; Puradax™ is sold by Genencor and KAC™ is sold by Kao corporation, Japan.

Detergent enzymes are usually incorporated in an amount of 0.00001% to 2%, and more preferably 0.001% to 0.5%, and even more preferably 0.005% to 0.2% in terms of pure enzyme protein by weight of the composition. Detergent enzymes are commonly employed in the form of granules made of crude enzyme alone or in combination with other components in the detergent composition. Granules of crude enzyme are used in such an amount that the pure enzyme is 0.001 to 50 weight percent in the granules. The granules are used in an amount of 0.002 to 20 and preferably 9.1 to 3 weight percent. Granular forms of detergent enzymes are known as Enzoguard™ granules, prills, marumes or T-granules. Other suitable forms of enzymes are liquid forms such as the "L" type liquids from Novo Nordisk, slurries of enzymes in nonionic surfactants such as the "SL" type sold by Novo Nordisk and microencapsulated enzymes marketed by Novo Nordisk under the tradename "LDP" and "CC".

The enzymes can be added as separate single ingredients (prills, granulates, stabilised liquids, etc. containing one enzyme) or as mixtures of two or more enzymes (e.g. cogranulates). Enzymes in liquid detergents can be stabilised by various techniques as for example disclosed in U.S. Pat. No. 4,261,868 and U.S. Pat. No. 4,318,818.

The detergent compositions of the present invention may additionally comprise one or more biologically active peptides such as swollenin proteins, expansins, bacteriocins and peptides capable of binding to stains.

Surfactant

The liquid composition of the invention may comprise from 1 to 90%, preferably from 10 to 70% by weight of a surfactant, preferably selected from anionic, nonionic, cationic, zwitterionic active detergent materials or mixtures thereof. Preferably, the compositions herein comprise 12 to 60% by weight of surfactant, more preferably 15 to 40% by weight.

Non-limiting examples of surfactants useful herein typically at levels from about 10% to about 70%, by weight, include the conventional $C_{11}$-$C_{18}$ alkylbenzene sulphonates ("LAS"), the $C_{10}$-$C_{18}$ secondary (2,3) alkyl sulphates of the formula $CH_3(CH_2)_x(CHOSO_3\text{-}M+)\ CH_3$ and $CH_3(CH_2)_y(CHOSO_3\text{-}M+)CH_2CH_3$ where x and (y+1) are integers of at least about 7, preferably at least about 9, and M is a water-solubilising cation, especially sodium, unsaturated sulphates such as oleyl sulphate, $C_{10}$-$C_{18}$ alkyl alkoxy carboxylates (especially the EO 1-7 ethoxycarboxylates), the $C_{10}$-$C_{18}$ glycerol ethers, the $C_{10}$-$C_{18}$ alkyl polyglycosides and their corresponding sulphated polyglycosides, and $C_{12}$-$C_{18}$ alpha-sulphonated fatty acid esters. If desired, the conventional nonionic and amphoteric surfactants such as the $C_{12}$-$C_{18}$ alkyl ethoxylates ("AE") including the so-called narrow peaked alkyl ethoxylates and $C_6$-$C_{12}$ alkyl phenol alkoxylates (especially ethoxylates and mixed ethoxy/propoxy), $C_{12}$-$C_{18}$ betaines and sulphobetaines ("sultaines"), $C_{10}$-$C_{18}$ amine oxides, and the like, can also be included in the overall compositions. The $C_{10}$-$C_{18}$ N-alkyl polyhydroxy fatty acid amides can also be used. Typical examples include the $C_{12}$-$C_{18}$ N-methylglucamides. See WO-92/06,154. Other sugar-derived surfactants include the N-alkoxy polyhydroxy fatty acid amides, such as $C_{10}$-$C_{18}$N-(3-methoxypropyl)glucamide. $C_{10}$-$C_{20}$ conventional soaps used. If high sudsing is desired, the branched-chain $C_{10}$-$C_{16}$ soaps may be used.

Other anionic surfactants useful for detersive purposes can also be included in the liquid compositions hereof. These can include salts (including, for example, sodium potassium, ammonium, and substituted ammonium salts such a mono-, di- and triethanolamine salts) of soap, $C_9$-$C_{20}$ linear alkylbenzenesulphonates, $C_8$-$C_{22}$ primary or secondary alkanesulphonates, $C_8$-$C_{24}$ olefinsulphonates, sulphonated polycarboxylic acids, alkyl glycerol sulphonates, fatty acyl glycerol sulphonates, fatty oleyl glycerol sulphates, alkyl phenol ethylene oxide ether sulphates, paraffin sulphonates, alkyl phosphates, isothionates such as the acyl isothionates, N-acyl taurates, fatty acid amides of methyl tauride, alkyl succinamates and sulphosuccinates, monoesters of sulphosuccinate (especially saturated and unsaturated $C_{12}$-$C_{18}$ monoesters) diesters of sulphosuccinate (especially saturated and unsaturated $C_6$-$C_{14}$ diesters), N-acyl sarcosinates, sulphates of alkylpolysaccharides such as the sulphates of alkylpolyglucoside, branched primary alkyl sulphates, alkyl polyethoxy carboxylates such as those of the formula $RO(CH_2CH_20)_kCH_2COO$-M+ wherein R is a $C_8$-$C_{22}$ alkyl, k is an integer from 0 to 10, and M is a soluble salt-forming cation, and fatty acids esterified with isethionic acid and neutralised with sodium hydroxide. Further examples are given in Surface Active Agents and Detergents (Vol. I and II by Schwartz, Perry and Berch).

The liquid detergent compositions of the present invention preferably comprise at least about 5%, preferably at least 10%, more preferably at least 12% and less than 70%, more preferably less than 60% by weight, of an anionic surfactant.

Alkyl alkoxylated sulphate surfactants are a preferred type of anionic surfactant. These surfactants are water soluble salts or acids typically of the formula $RO(A)mSO_3M$ wherein R is an unsubstituted $C_{10}$-$C_{24}$ alkyl or hydroxyalkyl group having a $C_{10}$-$C_{24}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between about 0.5 and about 6, more preferably between about 0.5 and about 3, and M is hydrogen or a water soluble cation which can be, for example, a metal cation (e.g., sodium, potassium, lithium, calcium, magnesium, etc.), ammonium or substituted-ammonium cation. Alkyl ethoxylated sulphates as well as alkyl propoxylated sulphates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines, e.g., monoethanolamine, diethanolamine, and triethanolamine, and mixtures thereof. Exemplary surfactants are $C_{12}$-$C_{18}$ alkyl polyethoxylate (1.0) sulphate, $C_{12}$-$C_{18}$ alkyl polyethoxylate (2.25) sulphate, $C_{12}$-$C_{18}$ alkyl polyethoxylate (3.0) sulphate, and $C_{12}$-$C_{18}$ alkyl polyethoxylate (4.0) sulphate wherein M is conveniently selected from sodium and potassium.

The liquid detergent compositions of the present invention preferably comprise at least about 5%, preferably at least 10%, more preferably at least 12% and less than 70%, more preferably less than 60% by weight, of a nonionic surfactant.

Preferred nonionic surfactants such as $C_{12}$-$C_{18}$ alkyl ethoxylates ("AE") including the so-called narrow peaked alkyl ethoxylates and $C_6$-$C_{12}$ alkyl phenol alkoxylates (especially ethoxylates and mixed ethoxy/propoxy), block alkylene oxide condensate of $C_6$ to $C_{12}$ alkyl phenols, alkylene oxide condensates of $C_8$-$C_{22}$ alkanols and ethylene oxide/propylene oxide block polymers (Pluronic™-BASF Corp.), as well as semi polar nonionics (e.g., amine oxides and phosphine oxides) can be used in the present liquid compositions. An extensive disclosure of these types of surfactants is found in U.S. Pat. No. 3,929,678.

Alkylpolysaccharides such as disclosed in U.S. Pat. No. 4,565,647 are also preferred nonionic surfactants in the liquid compositions of the invention. Further preferred nonionic surfactants are the polyhydroxy fatty acid amides.

A particularly desirable surfactant of this type for use in the liquid compositions herein is alkyl-N-methyl glucamide.

Other sugar-derived surfactants include the N-alkoxy polyhydroxy fatty acid amides, such as $C_{10}$-$C_{18}$ N-(3-methoxypropyl) glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used.

Another preferred anionic surfactant is a salt of fatty acids. Examples of fatty acids suitable for use of the present invention include pure or hardened fatty acids derived from palmitoleic, safflower, sunflower, soybean, oleic, linoleic, linolenic, ricinoleic, rapeseed oil or mixtures thereof. Mixtures of saturated and unsaturated fatty acids can also be used herein.

It will be recognised that the fatty acid will be present in the liquid detergent composition primarily in the form of a soap. Suitable cations include, sodium, potassium, ammonium, monoethanol ammonium diethanol ammonium, triethanol ammonium, tetraalkyl ammonium, e.g., tetra methyl ammonium up to tetradecyl ammonium etc. cations.

The amount of fatty acid will vary depending on the particular characteristics desired in the final liquid detergent composition. Preferably 0 to 30%, more preferably 1-20 most preferably 5-15% fatty acid is present in the inventive liquid composition.

Mixtures of anionic and nonionic surfactants are especially useful in a liquid detergent composition of the invention.

Carriers

Liquid detergent compositions of the invention may contain various solvents as carriers.

Low molecular weight primary or secondary alcohols exemplified by methanol, ethanol, propanol, and isopropanol are suitable. Other suitable carrier materials are glycols, such as mono-, di-, tri-propylene glycol, glycerol and polyethylene glycols (PEG) having a molecular weight of from 200 to 5000.

The compositions may contain from 1% to 50%, typically 5% to 30%, preferably from 2% to 10%, by weight of such carriers.

Detergency Builder

One or more detergency builders may be suitably present in the liquid detergent composition of the invention.

Examples of suitable organic detergency builders, when present, include the alkaline metal, ammonium and substituted ammonium polyacetates, carboxylates, polycarboxylates, polyacetyl carboxylates, carboxymethyloxysuccinates, carboxymethyloxymalonates, ethylene diamine-N,N-disuccinic acid salts, polyepoxysuccinates, oxydiacetates, triethylene tetramine hexa-acetic acid salts, N-alkyl imino diacetates or dipropionates, alpha sulpho-fatty acid salts, dipicolinic acid salts, oxidised polysaccharides, polyhydroxysulphonates and mixtures thereof.

Specific examples include sodium, potassium, lithium, ammonium and substituted ammonium salts of ethylenediamino-tetraacetic acid, nitrilo-triacetic acid, oxydisuccinic acid, melitic acid, benzene polycarboxylic acids and citric acid, tartrate mono succinate and tartrate di succinate.

Other Optional Ingredients

The compositions herein can further comprise a variety of optional ingredients. A wide variety of other ingredients useful in detergent compositions can be included in the compositions herein, including other active ingredients, carriers, hydrotropes, processing aids, dyes or pigments, solid fillers for bar compositions, etc.

If high sudsing is desired, suds boosters such as the $C_{10}$-$C_{16}$ alkanolamides can be incorporated into the compositions, typically at 1%-10% levels. The $C_{10}$-$C_{14}$ monoethanol and diethanol amides illustrate a typical class of such suds boosters. If desired, soluble magnesium salts such as $MgCl_2$, $MgS0_4$, and the like, can be added at levels of, typically, 0.1%-2%, to provide additional suds and to enhance grease removal performance.

Chelating Agents

The liquid detergent compositions herein may also optionally contain one or more iron, copper and/or manganese chelating agents. Such chelating agents can be selected from the group consisting of amino carboxylates, amino phosphonates, polyfunctionally-substituted aromatic chelating agents and mixtures therein, all as hereinafter defined.

If utilised, these chelating agents will generally comprise from about 0.1% to about 10% by weight of the detergent compositions herein. More preferably, if utilised the chelating agents will comprise from about 0.1% to about 3.0% by weight of such compositions.

Clay Soil Removal/Anti-Redeposition Agents

The compositions of the present invention can also optionally contain water-soluble ethoxylated amines having clay soil removal and antiredeposition properties.

Liquid detergent compositions typically contain about 0.01% to about 5% of these agents.

One preferred soil release and anti-redeposition agent is ethoxylated tetraethylenepentamine. Exemplary ethoxylated amines are further described in U.S. Pat. No. 4,597,898.

Other types of preferred antiredeposition agent include the carboxy methyl cellulose (CMC) materials. These materials are well known in the art.

Brightener

Any optical brighteners or other brightening or whitening agents known in the art can be incorporated at levels typically from about 0.05% to about 1.2%, by weight, into the liquid detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5, 5-dioxide, azoles, 5- and and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Suds Suppressors

Compounds for reducing or suppressing the formation of suds can be incorporated into the compositions of the present invention. Suds suppression can be of particular importance in the so-called "high concentration cleaning process" as described in U.S. Pat. No. 4,489,455 and U.S. Pat. No. 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430-447 (John Wiley & Sons, Inc., 1979). One category of suds suppressor of particular interest encompasses monocarboxylic fatty acid and soluble salts therein. See U.S. Pat. No. 2,954,347. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), etc.

The preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779.

For any detergent compositions to be used in automatic laundry washing machines, suds should not form to the extent that they overflow the washing machine.

Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines. The compositions herein will generally comprise from 0.1% to about 5% of suds suppressor.

Fabric Softeners

Various through-the-wash fabric softeners, especially the impalpable smectite clays of U.S. Pat. No. 4,062,647 as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416 and U.S. Pat. No. 4,291,071.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

Bleaches

Optionally, the composition according to the present invention may contain a bleach or bleach system.

This bleach or bleach system may be, for example: (a) a peroxygen bleach species alone and/or in combination with a bleach activator and/or a transition metal catalyst; and (b) a transition metal catalysts in a composition substantially devoid of peroxygen species.

Bleaching catalysts for stain removal have been developed over recent years and may be used in the present invention. Examples of transition metal bleaching catalysts that may be used are found, for example, in: WO-01/48298, WO-00/60045, WO-02/48301, WO-00/29537 and WO-00/12667. The catalyst may alternatively be provided as the free ligand that forms a complex in situ. Bleach activators are also well known in the art. The exact mode of action of bleach activators for peroxybleach compounds is not known, but it is believed that peracids are formed by reaction of the activators with the inorganic peroxy compound, which peracids then liberate active-oxygen by decomposition. They are generally compounds which contain N-acyl or O-acyl residues in the molecule and which exert their activating action on the peroxy compounds on contact with these in the washing liquor.

Typical examples of activators within these groups are polyacylated alkylene diamines, such N,N,N$^1$N,$^1$-tetraacetylethylene diamine (TAED) and N,N,N$^1$,N$^1$-tetraacetylmethylene diamine (TAMD); acylated glycolurils, such as tetraacetylgylcoluril (TAGU); triacetylcyanurate and sodium sulphophenyl ethyl carbonic acid ester.

Peroxygen bleaching agents are also well known in the art, for example, peracids (e.g., PAP), perborates, percarbonates, peroxyhydrates, and mixtures thereof. Specific preferred examples include: sodium perborate, commercially available in the form of mono- and tetra-hydrates, and sodium carbonate peroxyhydrate. Other examples of peroxyl species and activators as well as other transition metal catalyst are found in WO-02/077145.

It is also preferred to include in the compositions, a stabiliser for the bleach or bleach system, for example ethylene diamine tetramethylene phosphonate and diethylene triamine pentamethylene phosphonate or other appropriate organic phosphonate or salt thereof. These stabilisers can be used in acid or salt form which is the calcium, magnesium, zinc or aluminium salt form. The stabiliser may be present at a level of up to about 1% by weight, preferably between about 0.1% and about 0.5% by weight.

Since many bleaches and bleach systems are unstable in aqueous liquid detergents and/or interact unfavourably with other components in the composition, e.g. enzymes, they may for example be protected, e.g. by encapsulation or by formulating a structured liquid composition, whereby they are suspended in solid form.

The invention will now be illustrated by way of the following non-limiting examples, in which all parts and percentages are by weight unless otherwise indicated.

EXAMPLES

The following 'base' liquid detergent formulation was prepared: Ingredient % by weight

| Ingredient | % by weight |
|---|---|
| LAS acid | 6.0 |
| SLES 3EO | 6.0 |
| NI 7EO | 6.0 |
| Proxel GXL | 0.016 |
| Sorbitol | 3.3 |
| Borax•10$H_2O$ | 2.3 |
| MPG | 4.7 |
| NaOH | 0.75 |
| Prifac 7908 | 1.0 |
| Protease enzyme | 0.4 |
| Water | balance to 100 |

Wherein:
LAS acid = $C_{10}$-$C_{14}$ alkyl benzene sulphonic acid;
sLES = sodium lauryl ether sulphate (with on average 3 ethylene oxide groups);
NI 7EO = $C_{12}$-$C_{13}$ fatty alcohol ethoxylated with an average of 7 ethylene oxide groups;
MPG = monopropylene glycol;
Prifac 7908 = palmkernel fatty acid
Proxel GXL = biocide (20% active)

To various samples of this 'base' liquid formulation 0.06% by weight based on said formulation of several types of perfume component—as indicated in the tables below—were added such that, as a result, each sample contains a different type of perfume component. To other samples of this 'base' formulation not only 0.06% by weight of said perfume components but also 0.05% by weight BHT (2,6-di-tert-butyl hydroxy toluene) were added.

The residual activity of the protease enzyme in all thus-formed formulations after 2 weeks and 4 weeks storage at 37° C., was determined at 40° C. in a TRIS pH 9 buffer and using tetrapeptide as substrate. For this determination, the following protocol was used:

Samples of 70 mg of the tested liquid formulation were diluted in 10.00 ml MilliQ water. 10 μl of this solution was added to an assay of 205 μl containing 74.4 mM TRIS pH9 and 0.494 mM tetrapeptide (succinyl-Ala-Ala-Pro-Phe-p-Nitroanilide). The absorbance of the tested samples at a wavelength of 450 nm was measured for 15 minutes at 40° C., using a spectrophotometer. The absolute changes in absorbance as compared to the absorbance measured on a freshly prepared calibration sample were correlated to the measured activity of such freshly prepared sample. The measured protease enzyme activity is expressed as GU/ml.

The residual enzyme activity (expressed as %) is the enzyme activity after storage of the liquid formulation concerned divided by the enzyme activity measured at t=0.

Tables 1 and 2 show the effect of the addition of 0.05% by weight of BHT on the residual enzyme activity in 'base' liquid detergent formulations additionally containing 0.06% by weight of the indicated perfume components, after 2 weeks storage at 37° C. respectively 4 weeks storage at 37° C.

TABLE 1

| | Residual activity after 2 weeks | |
|---|---|---|
| Perfume component | No BHT | 0.05% BHT |
| -none- | 56 | — |
| Zestover | 16 | 82 |
| Lilial | 39 | 80 |
| Octenal | 13 | 68 |
| Tridecyclenaldehyde | 14 | 70 |
| Pulegone | 45 | 82 |
| Alpha methylionone | 39 | 84 |
| Terpinolene | 51 | 85 |
| Terpinegene G | 48 | 72 |

TABLE 2

| | Residual activity after 4 weeks | |
|---|---|---|
| Perfume component | No BHT | 0.05% BHT |
| -none- | 29 | — |
| Zestover | 5 | 72 |
| Lilial | 9 | 68 |
| Octenal | 3 | 46 |
| Tridecyclenaldehyde | 4 | 54 |
| Pulegone | 16 | 76 |
| Alpha methylionone | 14 | 78 |
| Terpinolene | 17 | 79 |
| Terpinegene G | 23 | 62 |

The invention claimed is:

1. A liquid detergent composition comprising:

(a) a cleaning effective amount of a proteolytic enzyme;

(b) 0.001% to 3% by weight of a perfume composition, wherein the perfume composition comprises at least 0.01% by weight based on the liquid composition of a perfume component selected from terpenes, ketones, aldehydes and mixtures thereof; and (c) 0.01% to 0.08% by weight of an antioxidant, wherein the antioxidant is 2,6-dit-tert-butyl-hydroxy toluene.

2. A liquid composition according to claim 1, wherein the enzyme is present at a concentration of from 0.001 mg to 3 mg of the enzyme per gram of liquid composition.

3. A liquid composition according to claim 1, wherein the perfume composition is present at a concentration of from 0.01 to 2% by weight.

4. A liquid composition according to claim 1, wherein said perfume composition comprises at least 5% by weight, based on the liquid composition, of a perfume component.

5. A liquid composition according to claim 1, wherein the perfume composition comprises a perfume component, which is a terpene selected from the group consisting of terpinolene, gamma-terpinene, and pinane.

6. A liquid composition according to claim 1, wherein the perfume composition comprises a perfume component, which is an aldehydic perfume selected from the group consisting of trifernal, lilial, citronellal, cyclosal, heliopropanal, zestover, aldehyde C12, tridecylenicaldehyde, cyclosia base, and octenal.

7. A liquid composition according to claim 1, wherein the perfume composition comprises a perfume component, which is a ketone selected from the group consisting of pulegone, vertofix coeur, veloutone, alpha-methylionone, and damascenone.

8. A liquid composition according to claim 1, wherein the antioxidant is present in an amount of 0.05% by weight.

9. A method of cleaning a fabric substrate, comprising treating a fabric substrate with the liquid composition of claim 1 in an aqueous environment, rinsing the substrate and drying the substrate.

* * * * *